US009787041B1

(12) United States Patent
Ke et al.

(10) Patent No.: US 9,787,041 B1
(45) Date of Patent: Oct. 10, 2017

(54) HIGH FREQUENCY ELECTRICAL CONNECTOR

(71) Applicant: GREENCONN CORPORATION, New Taipei (TW)

(72) Inventors: Jiun Fu Ke, New Taipei (TW); Kun Shen Wu, New Taipei (TW)

(73) Assignee: GREENCONN CORPORATION, New Taipei (TW)

( * ) Notice: Subject to any disclaimer, the term of this patent is extended or adjusted under 35 U.S.C. 154(b) by 0 days.

(21) Appl. No.: 15/158,619

(22) Filed: May 19, 2016

(30) Foreign Application Priority Data

Apr. 8, 2016 (TW) ..... 105111055
Apr. 8, 2016 (TW) ..... 105204874

(51) Int. Cl.

| | |
|---|---|
| ***H01R 12/00*** | (2006.01) |
| ***H01R 27/02*** | (2006.01) |
| ***H01R 12/79*** | (2011.01) |
| ***H01R 13/6461*** | (2011.01) |
| ***H01R 13/428*** | (2006.01) |

(52) U.S. Cl.
CPC ..... *H01R 27/02* (2013.01); *H01R 12/79* (2013.01); *H01R 13/428* (2013.01); *H01R 13/6461* (2013.01)

(58) Field of Classification Search
CPC ..... H01R 27/00; H01R 23/025; H01R 31/02; H01R 33/92; H01R 2201/06
USPC ..... 439/637, 639, 76.1, 947, 60
See application file for complete search history.

(56) References Cited

U.S. PATENT DOCUMENTS

| | | | | |
|---|---|---|---|---|
| 3,631,381 | A * | 12/1971 | Pittman | H01R 12/721 439/637 |
| 6,887,101 | B2 * | 5/2005 | Ito | H01R 33/945 439/577 |
| 7,232,345 | B2 * | 6/2007 | Ishizuka | H01R 13/6585 439/660 |
| 7,357,663 | B2 * | 4/2008 | Wei | H01R 12/79 439/260 |
| 7,427,208 | B2 * | 9/2008 | Yang | H01R 12/7052 439/326 |
| 7,488,188 | B2 * | 2/2009 | Moriyama | H01R 13/26 439/108 |

(Continued)

FOREIGN PATENT DOCUMENTS

| | | |
|---|---|---|
| NO | 2014049426 A2 | 4/2014 |
| TW | M512237 U | 11/2015 |
| TW | M532107 U | 11/2016 |

*Primary Examiner* — Abdullah Riyami
*Assistant Examiner* — Vladimir Imas
(74) *Attorney, Agent, or Firm* — Mark M. Friedman

(57) ABSTRACT

A high frequency electrical connector is described. The high frequency electrical connector comprises an insulated housing forming a plurality of first contact slots and a plurality of second contact slots along an arrangement direction within the insulated housing. A plurality of first type conductive contacts are inserted to the first contact slots correspondingly and a plurality of second type conductive contacts are inserted to the second contact slots correspondingly. When a plurality of first free end portions of the first type conductive contacts electrically connects the corresponding contacts of the mating electrical connector for transmitting a high frequency signal to the mating electrical connector, the high frequency electrical connector is capable of advantageously reducing the signal decay of the high frequency signal.

23 Claims, 15 Drawing Sheets

(56) References Cited

U.S. PATENT DOCUMENTS 7,806,732 B1 * 10/2010 Yen ..... H01R 27/00 439/660
8,033,869 B1 * 10/2011 Zhu ..... H01R 31/06 439/638
8,202,127 B2 * 6/2012 Zhang ..... H01R 24/60 439/660
8,353,726 B2 * 1/2013 Zhang ..... H01R 12/721 439/629
8,382,519 B2 * 2/2013 Lin ..... H01R 13/6485 439/607.01
8,651,880 B2 * 2/2014 Wu ..... H01R 13/112 439/595
8,702,451 B2 * 4/2014 Luo ..... H01R 12/725 439/607.28
8,708,750 B2 * 4/2014 Ho ..... H01R 27/02 439/639
8,740,631 B2 * 6/2014 Chen ..... H01R 12/62 439/76.1
8,961,242 B2 * 2/2015 Kim ..... H01R 13/04 439/60
9,004,941 B2 * 4/2015 Wang ..... H01R 24/60 439/607.01
9,318,858 B2 * 4/2016 Saito ..... H01R 27/00
9,401,573 B1 * 7/2016 Fernandez ..... H01R 13/6593
9,450,360 B2 * 9/2016 Zhu ..... H01R 27/00
2012/0108109 A1 * 5/2012 Zhang ..... H01R 12/721 439/629
2012/0282808 A1 * 11/2012 Luo ..... H01R 13/6471 439/607.28
2013/0052879 A1 * 2/2013 Chin ..... H01R 12/724 439/660
2013/0052880 A1 * 2/2013 Wu ..... H01R 12/58 439/660
2013/0052881 A1 * 2/2013 Chin ..... H01R 13/113 439/668
2013/0059479 A1 * 3/2013 Ho ..... H01R 27/02 439/639
2013/0109201 A1 * 5/2013 Wu ..... H01R 12/7005 439/59
2013/0109239 A1 * 5/2013 Wu ..... H01R 13/113 439/629
2014/0004744 A1 1/2014 Hsu et al.
2015/0255927 A1 9/2015 Goh et al.

* cited by examiner

HIGH FREQUENCY ELECTRICAL CONNECTOR

BACKGROUND OF THE INVENTION

Field of Invention

The present invention relates to a connector, and more particularly to a high frequency electrical connector.

Description of Prior Art

With the rising demand on the miniaturization and high speed data transmission of a variety of data storage media, e.g. hard disk drive, the size of the dedicated electrical connector for transmitting high frequency signal, e.g. a connector compatible to Serial Advanced Technology Attachment (SATA) protocol tends to compact and light-weight design and it is required to contain more and more conductive contacts with different applications. With a limited amount in the electrical connector, the arrangement density of conductive contacts accommodated in the electrical connector is facing a major challenge since the pitch between two conductive contacts of the electrical connector is smaller in dimension and subjects to the standard pitch defined in a specific connector protocol. Due to the above-described standards, a change in impedance of the conductive contacts results in the problem of impedance matching between male connector and female connector so that the high frequency signal between the male and female connectors cannot be correctly transmitted.

Furthermore, the high frequency signal passes through the conductive contacts, the adjacent conductive contacts therebetween causes a crosstalk effect, which results in downgrading the transmission stability of the high frequency signal. In some conventional techniques, a conductive sheet or shell is covered with the electrical connector to electrically connect to the ground path of the electrical connector so that the conductive sheet or shell is able to absorb the electrical field or magnetic field, which is produced by the high frequency signal and causes the crosstalk effect, to reduce the crosstalk effect, however, the conductive sheet or shell will increase the manufacturing cost. Consequently, there is a need to develop a novel electrical connector to solve the problems of the conventional technique.

SUMMARY OF THE INVENTION

Therefore, one objective of the present invention is to provide a high frequency electrical connector for adjusting a differential impedance interval to improve the impedance matching reliability of the high frequency electrical connector and avoid crosstalk between the conductive contacts wherein the differential impedance interval is less than a reference differential impedance interval.

Based on the above objective, a first embodiment of the present invention sets forth a high frequency electrical connector. The high frequency electrical connector comprises an insulated housing comprising a plurality of first contact slots and a plurality of second contact slots which are assembled in the insulated housing along an arrangement direction; a plurality of first type conductive contacts, for being inserted to the first contact slots of the insulated housing correspondingly, wherein each first type conductive contact comprises: a first soldering portion, for extending outwardly from the insulated housing; a first retention portion connected to the first soldering portion, for resisting on a sidewall within the insulated housing in order to retain the first type conductive contact into the first contact slot of the insulated housing correspondingly; a first resilient portion, for extending a predetermined distance from the first retention portion to an insertion direction of the high frequency electrical connector; and a first contact portion connected to the first resilient portion at an angle and having a first free end portion at a distal part of the first contact portion, wherein the first free end portion forms a first width along the arrangement direction, the first contact portion forms a first thickness along a direction which is perpendicular to the arrangement direction and the insertion direction, and the first thickness is greater than the first width; and a plurality of second type conductive contacts, for being inserted to the second contact slots of the insulated housing correspondingly; wherein the first free end portions of the first type conductive contacts electrically connects the corresponding contacts of the mating electrical connector for transmitting a high frequency signal to the mating electrical connector so as to reduce an amplitude decay when the high frequency electrical connector sends the high frequency signal.

In one embodiment, the high frequency electrical connector is a non-metal shielding electrical connector which is compatible to a protocol selected from one group consisting of SATA protocol, SAS-3 protocol and the combination.

In one embodiment, a differential impedance of the first type conductive contacts is either less than or equal to a reference differential impedance defined in third-generation Serial Attached Small Computer System Interface (SAS-3) protocol, lower or higher version for reducing the amplitude decay of the high frequency signal.

In one embodiment, the reference differential impedance has a range from 85 to 115 ohms.

In one embodiment, two lateral sides of two adjacent first type conductive contacts are spaced a first edge distance apart and two lateral sides of two adjacent second type conductive contacts are spaced a second edge distance apart which is greater than the first edge distance.

In one embodiment, each second type conductive contact comprises: a second soldering portion, for extending outwardly from the insulated housing; a second retention portion connected to the second soldering portion, for resisting on a sidewall of the second contact slot in order to retain the second type conductive contact into the second contact slot of the insulated housing correspondingly; a second resilient portion, for extending a predetermined distance from the second retention portion to the insertion direction of the high frequency electrical connector; and a second contact portion connected to the second resilient portion at an angle and having a second free end portion at a distal part of the second contact portion, wherein the second end portion forms a second width along the arrangement direction, the second contact portion forms a second thickness along a direction which is perpendicular to the arrangement direction and the insertion direction, and the second thickness is greater than the second width.

In one embodiment, the first type conductive contacts and the second type conductive contacts are formed by a blanking type.

In one embodiment, when the second free end portions of the second type conductive contacts electrically connects the corresponding contacts of the mating electrical connector for transmitting the high frequency signal to the mating electrical connector, a reference differential impedance of the second type conductive contacts is either less than or equal to a differential impedance defined in SATA protocol for reducing the amplitude decay of the high frequency signal.

In one embodiment, the reference differential impedance has a range from 85 to 115 ohms.

In one embodiment, the first type conductive contacts comprise: a first group conductive terminals; and a second group conductive terminals, wherein a transverse section of the first resilient portion of each first group conductive terminal and a transverse section of the first resilient portion of each second group conductive terminal are interlaced in the front and rear along the arrangement direction within the first contact slots of the insulated housing, and the first free end portions of the first group conductive terminals and the second group conductive terminals are formed by a collinear status or a coplanar status.

In one embodiment, an overlapped region between two adjacent first resilient portions of the interlaced first group conductive terminal and second group conductive terminal along the arrangement direction is less than a surface region of the first resilient portion of either the interlaced first group conductive terminal or second group conductive terminal along the arrangement direction.

In one embodiment, an offset distance is formed between a center line of the transverse section of the first resilient portion of each first group conductive terminal and a center line of the transverse section of the first resilient portion of each second group conductive terminal along the arrangement direction.

In one embodiment, the high frequency electrical connector further comprises a plurality of third type conductive contacts, for being inserted to a plurality of third contact slots of the insulated housing correspondingly wherein each third type conductive contact comprises a third soldering portion, a third resilient portion, a bending contact portion and a third free end portion, and a length between the third soldering portion and the third free end portion is greater than a length between the first soldering portion and the first free end portion of the first type conductive contact.

In second embodiment of the present invention, the high frequency electrical connector comprises: an insulated housing comprising a plurality of first contact slots and a plurality of second contact slots which are assembled in the insulated housing along an arrangement direction; a plurality of first type conductive contacts, for being inserted to the first contact slots of the insulated housing correspondingly wherein each first type conductive contact comprises a first resilient portion and a first contact portion which is connected to the first resilient portion at an angle and comprises a first free end portion at a distal part of the first contact portion, and the first type conductive contacts comprise: a first group conductive terminals; and a second group conductive terminals which are different from the first group conductive terminals, wherein a transverse section of the first resilient portion of each first group conductive terminal and a transverse section of the second resilient portion of each second group conductive terminal are interlaced in the front and rear along the arrangement direction within the first contact slots of the insulated housing, and the first free end portions of the first group conductive terminals and the second group conductive terminals are formed by a collinear status or a coplanar status; and a plurality of second type conductive contacts, for being inserted to the second contact slots of the insulated housing correspondingly.

In one embodiment, the high frequency electrical connector is a non-metal shielding electrical connector which is compatible to a protocol selected from one group consisting of SATA protocol, SAS-3 protocol and the combination.

In one embodiment, two lateral sides of two adjacent first type conductive contacts forms a first edge distance and two lateral sides of two adjacent second type conductive contacts forms a second edge distance which is greater than the first edge distance.

In one embodiment, the first type conductive contacts and the second type conductive contacts are formed by a blanking type.

In one embodiment, each second type conductive contact comprises: a second resilient portion; and a second contact portion connected to the second resilient portion at an angle and having a second free end portion at a distal part of the second contact portion.

In one embodiment, when the second free end portions of the second type conductive contacts electrically connects the corresponding contacts of the mating electrical connector for transmitting the high frequency signal to the mating electrical connector, a reference differential impedance of the second type conductive contacts is either less than or equal to a differential impedance defined in SATA protocol for reducing the amplitude decay of the high frequency signal.

In one embodiment, the reference differential impedance has a range from 85 to 115 ohms.

In one embodiment, an overlapped region between two adjacent first resilient portions of the interlaced first group conductive terminal and second group conductive terminal along the arrangement direction is less than a surface region of the first resilient portion of either the interlaced first group conductive terminal or second group conductive terminal along the arrangement direction.

In one embodiment, an offset distance is formed between a center line of the transverse section of the first resilient portion of each first group conductive terminal and a center line of the transverse section of the second resilient portion of each second group conductive terminal along the arrangement direction.

In one embodiment, the high frequency electrical connector further comprises a plurality of third type conductive contacts, for being inserted to a plurality of third contact slots of the insulated housing correspondingly wherein each third type conductive contact comprises a third soldering portion, a third resilient portion, a bending contact portion and a third free end portion, and a length between the third soldering portion and the third free end portion is greater than a length between the first soldering portion and the first free end portion of the first type conductive contact.

DETAILED DESCRIPTION OF THE PREFERRED EMBODIMENTS

Figure 1:
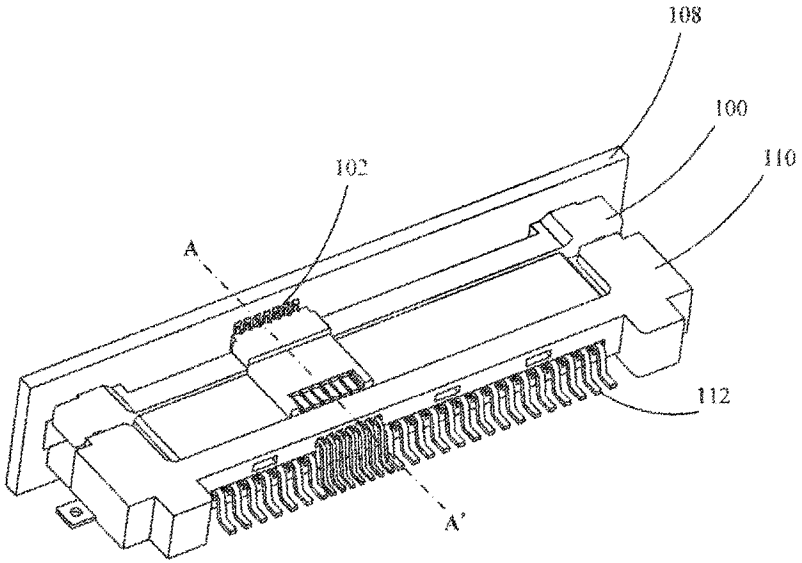
FIG. 1 is a schematic three-dimensional assembly view of a high frequency electrical connector according to a first embodiment of the present invention.

The following embodiments refer to the accompanying drawings for exemplifying specific implementable embodiments of the present invention. Furthermore, directional terms described by the present invention, such as upper, lower, front, back, left, right, inner, outer, side, etc., are only directions by referring to the accompanying drawings, and thus the used directional terms are used to describe and understand the present invention, but the present invention is not limited thereto. In the drawings, the same reference symbol represents the same or a similar component.

Figure 2:
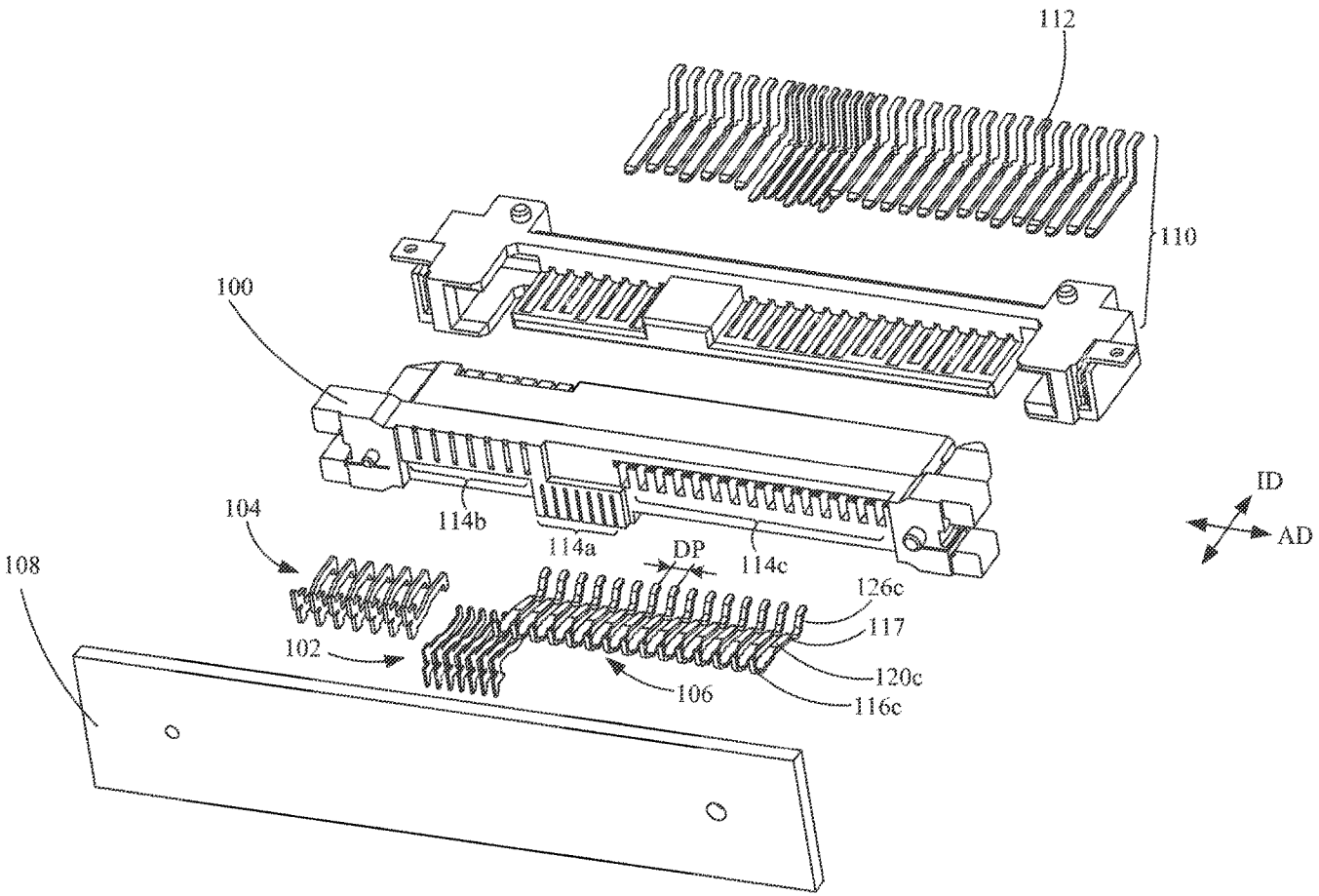
FIG. 2 is a schematic exploded view of the high frequency electrical connector in FIG. 1 according to the first embodiment of the present invention.
Figure 3:
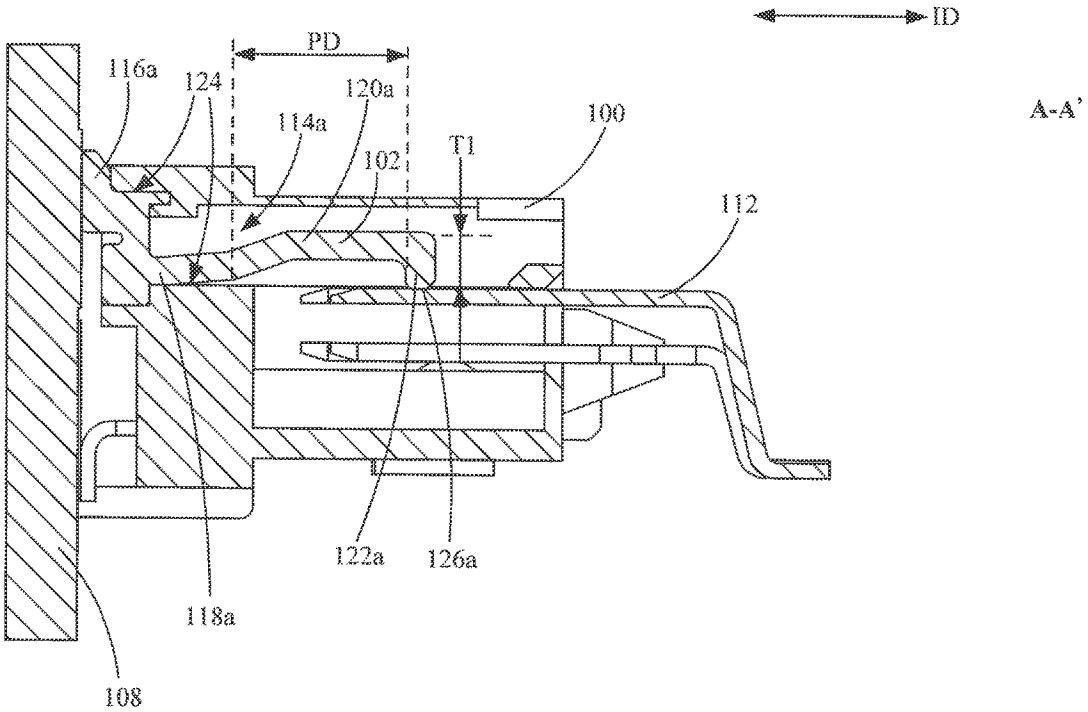
FIG. 3 is a schematic cross-sectional view of the high frequency electrical connector in FIG. 1 along the line A-A' according to the first embodiment of the present invention.

Please refer to FIG. 1 through FIG. 3. FIG. 1 is a schematic three-dimensional assembly view of a high frequency electrical connector according to a first embodiment of the present invention. FIG. 2 is a schematic exploded view of the high frequency electrical connector in FIG. 1 according to the first embodiment of the present invention. FIG. 3 is a schematic cross-sectional view of the high frequency electrical connector in FIG. 1 along the line A-A' according to the first embodiment of the present invention. The high frequency electrical connector comprises an insulated housing 100, a plurality of first type conductive contacts 102, a plurality of second type conductive contacts 104, a plurality of third type conductive contacts 106 and a circuit board 108. In one embodiment, the high frequency electrical connector is a non-metal shielding electrical connector which is compatible to a protocol selected from one group consisting of SATA protocol, SAS-3 protocol and the combination. As shown in FIG. 1, the high frequency electrical connector is a electrical connector which is compatible to a combination of SATA protocol and SAS-3 protocol. In FIG. 1, a high frequency electrical connector, e.g. female connector, is electrically connected to an opposite or mating high frequency electrical connector 110, e.g. male connector to transmit high frequency signal via the conductive contacts of the high frequency electrical connector 110.

In FIG. 2 and FIG. 3, an insulated housing 100 forms a plurality of first contact slots 114*a* and a plurality of second contact slots 114*b* which are assembled in the insulated housing 100 along an arrangement direction AD. A plurality of first type conductive contacts 102 are inserted to the first contact slots 114*a* of the insulated housing 110 correspondingly wherein each first type conductive contact 102 comprises a first soldering portion 116*a*, a first retention portion 118*a*, a first resilient portion 120 and a first contact portion 122*a*.

As shown in FIG. 2 and FIG. 3, first soldering portions 116*a* extend outwardly from the insulated housing 100. For example, first soldering portions 116*a* are the soldering pins using surface mounting technique (SMT) to electrically connecting to the soldering pads (not shown) in the rear end of the circuit board 108. The first retention portion 118*a* is connected to the first soldering portion 116*a* for resisting on a sidewall 124 within the insulated housing 100 in order to retain the first type conductive contact 102 into the first contact slot 114*a* of the insulated housing 100 correspondingly. The first resilient portion 120*a* extends a predetermined distance PD from the first retention portion 118*a* to an insertion direction ID of the high frequency electrical connector. The first contact portion 122*a* is connected to the first resilient portion 120*a* at an angle, e.g. 90 degrees or arbitrary angles, and comprises a first free end portion 126*a* at a distal part of the first contact portion 122*a*. The first free end portion 126*a* forms a first width W1 (shown in FIG. 4B) along the arrangement direction AD and the first contact portion 122*a* forms a first thickness T1 along a direction which is perpendicular to the arrangement direction AD and the insertion direction ID wherein the first thickness T1 is greater than the first width W1.

Figure 4B:
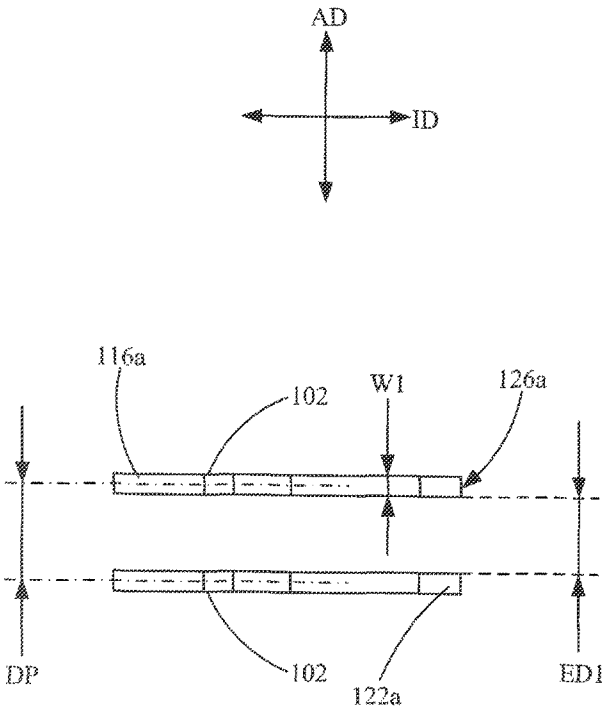
FIG. 4B is a schematic planar view of two adjacent first type conductive contacts according to the first embodiment of the present invention.
Figure 4A:
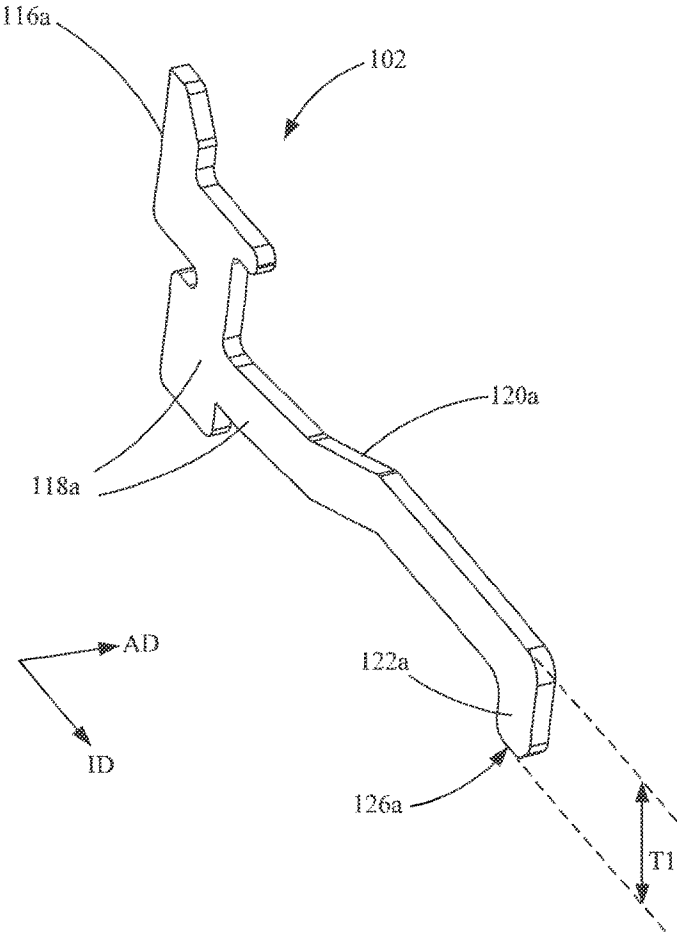
FIG. 4A is a schematic three-dimensional view of a first type conductive contact according to the first embodiment of the present invention.
Figure 6A:
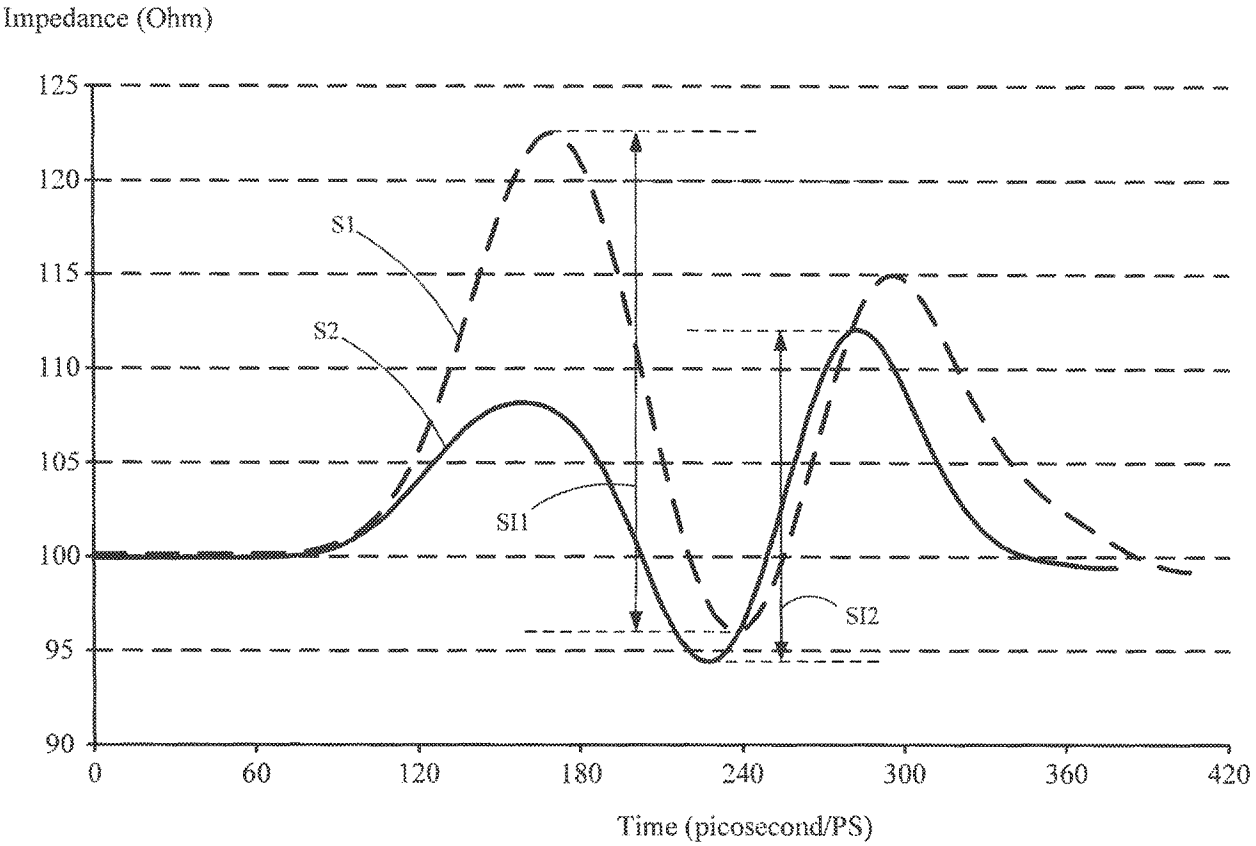
FIGS. 6A-6C are schematic electrical characteristics waveform views of conductive contacts according to the first embodiment of the present invention.

Please refer to FIGS. 3, 4A, 4B and 6A. FIG. 4A is a schematic three-dimensional view of a first type conductive contact 102 according to the first embodiment of the present invention. FIG. 4B is a schematic planar view of two adjacent first type conductive contacts 102 according to the first embodiment of the present invention. FIG. 6A is schematic electrical characteristics waveform view of conductive contacts according to the first embodiment of the present invention. In the embodiment of FIG. 4A and FIG. 4B, the first contact portion 122*a* of the first type conductive contact 102 is perpendicular to the first resilient portion 120*a* and the first free end portion 126*a* is electrically connected to the mating contact 112 of the opposite high frequency electrical connector 110 along the vertical direction wherein the first contact portion 122*a* forms a first thickness T1 along the insertion direction ID. Every two first type conductive contacts 102 are spaced an arrangement pitch DP apart and every two lateral sides of two adjacent first type conductive contacts 102 are spaced a first edge distance ED1 apart. The heights of the first type conductive contacts 102 along the arrangement direction AD are the same wherein the arrangement pitch DP is greater than the first edge distance ED1.

As shown in FIG. 6A, the horizontal axis represents time (picosecond, PS) and the vertical axis represents impedance value (ohms). The curve S1 is an impedance curve of the conventional electrical connector and the curve S2 is an impedance curve of the high frequency electrical connector of the present invention wherein a range SI1 is defined as a differential impedance interval to indicate the range of impedance change in the prior art and a range SI2 is defined as a differential impedance interval to indicate the impedance change range of the high frequency electrical connector. Since the differential impedance interval SI2 is less than a reference differential impedance interval, the impedance matching of the first type conductive contacts of the differential impedance interval SI2 is improved. Specifically, in one embodiment of the FIG. 6A, the differential impedance interval SI2 comprises a range from 94 to 112 ohms which is less than the reference differential impedance having a range from 85 to 115 ohms, thereby improving the impedance matching of the high frequency electrical connector. In one embodiment, a differential impedance of the first type conductive contacts 102 is either less than or equal to a reference differential impedance defined in SAS-3 protocol or a later version for reducing the amplitude decay of the high frequency signal. Based on the above descriptions, the present invention utilizes a high frequency electrical connector for configuring the contact arrangement between the first type conductive contacts 102 to optimize the impedance matching status between the high frequency electrical connector and the opposite electrical connector 110. In other words, the high frequency signal is transmitted from the opposite electrical connector 110 to an electrical device (not shown) via the high frequency electrical connector wherein the decay of the high frequency signal is less than a threshold value so that the signal amplitude is not unduly decreased during the transmission process to increase the transmission quality of the high frequency signal in the high frequency electrical connector.

Figure 5B:
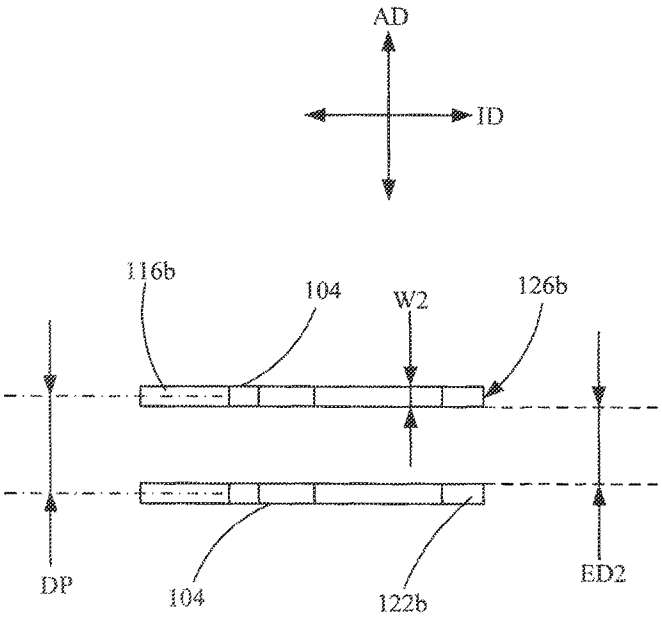
FIG. 5B is a schematic planar view of two adjacent second type conductive contacts according to the first embodiment of the present invention.
Figure 5A:
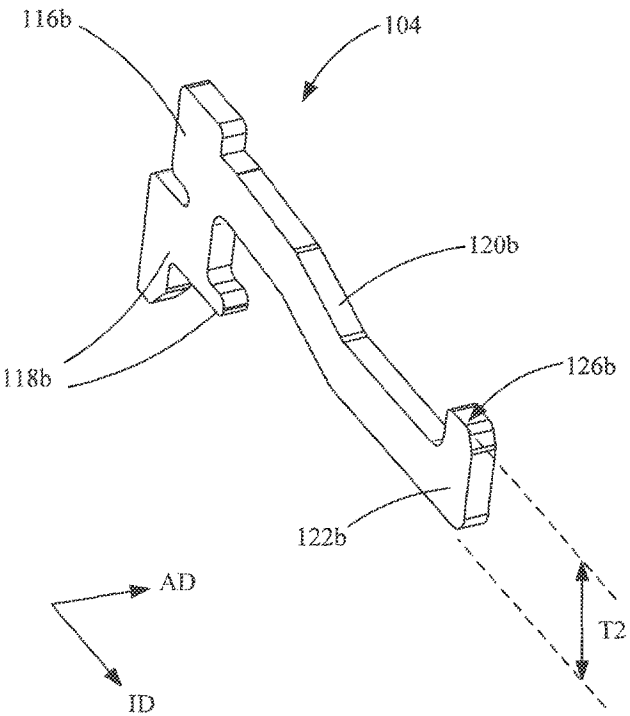
FIG. 5A is a schematic three-dimensional view of a second type conductive contact according to the first embodiment of the present invention.

Please refer to FIGS. 2, 5A, 5B and 6A. FIG. 5A is a schematic three-dimensional view of a second type conductive contact 104 according to the first embodiment of the present invention. FIG. 5B is a schematic planar view of two adjacent second type conductive contacts 104 according to the first embodiment of the present invention. A plurality of second type conductive contacts 104 are inserted to the second contact slots 114*b* of the insulated housing 100 correspondingly. Each second type conductive contact 104 comprises a second soldering portion 116*b*, a second retention portion 118*b*, a second resilient portion 120*b* and a second contact portion 122*b*. The second soldering portion 116*b* extends outwardly from the insulated housing 100 in order to retain the second type conductive contact 104 into the second contact slot 114*b* of the insulated housing 100 correspondingly. The second retention portion 118*b* is connected to the second soldering portion 116*b* for resisting on a sidewall (not shown) of the second contact slot 114*b* in order to retain the second type conductive contact 104 into the second contact slot 114*b* of the insulated housing 100 correspondingly. The second resilient portion 120*b* extends a predetermined distance (not shown) from the second retention portion 118*b* to the insertion direction ID of the high frequency electrical connector. The second contact portion 122*b* is connected to the second resilient portion 120*b* at an angle, e.g. 90 degrees or arbitrary angles, and comprises a second free end portion 126*b* at a distal part of the second contact portion, wherein the second end portion 126*b* forms a second width W2 along the arrangement direction AD, the second contact portion 122*b* forms a second thickness T2 along a direction which is perpendicular to the arrangement direction AD and the insertion direction ID, and the second thickness T2 is greater than the second width W2.

In the embodiment of FIGS. 5A and 5B, the second contact portion 122*b* of the second type conductive contact 104 is perpendicular to the second resilient portion 120*b* and the second free end portion 126*b* is electrically connected to the mating contact 112 of the opposite high frequency electrical connector 110 along the vertical direction wherein the second contact portion 122*b* forms a second thickness T2 along the insertion direction ID. Every two second type conductive contacts 104 are spaced an arrangement pitch DP apart and every two lateral sides of two adjacent second type conductive contacts 104 are spaced a second edge distance ED2 apart. The heights of the second type conductive contacts 104 along the arrangement direction AD are the same wherein the arrangement pitch DP is greater than the second edge distance ED2. When the second free end portions 126*b* of the second type conductive contacts 104 electrically connects the corresponding contacts of the mating electrical connector for transmitting the high frequency signal to the mating electrical connector, a reference differential impedance of the second type conductive contacts 104 is either less than or equal to a differential impedance defined in SATA protocol for reducing the amplitude decay of the high frequency signal.

As shown in FIGS. 4A, 4B, 5A and 5B, every two lateral sides of two adjacent first type conductive contacts 102 are spaced a first edge distance ED1 apart and every two lateral sides of two adjacent second type conductive contacts 104 are spaced a second edge distance ED2 apart wherein the second edge distance ED2 is greater than the first edge distance ED1. In one embodiment, the first type conductive contacts 102 and the second type conductive contacts 104 are formed by a blanking type.

Figure 6B:
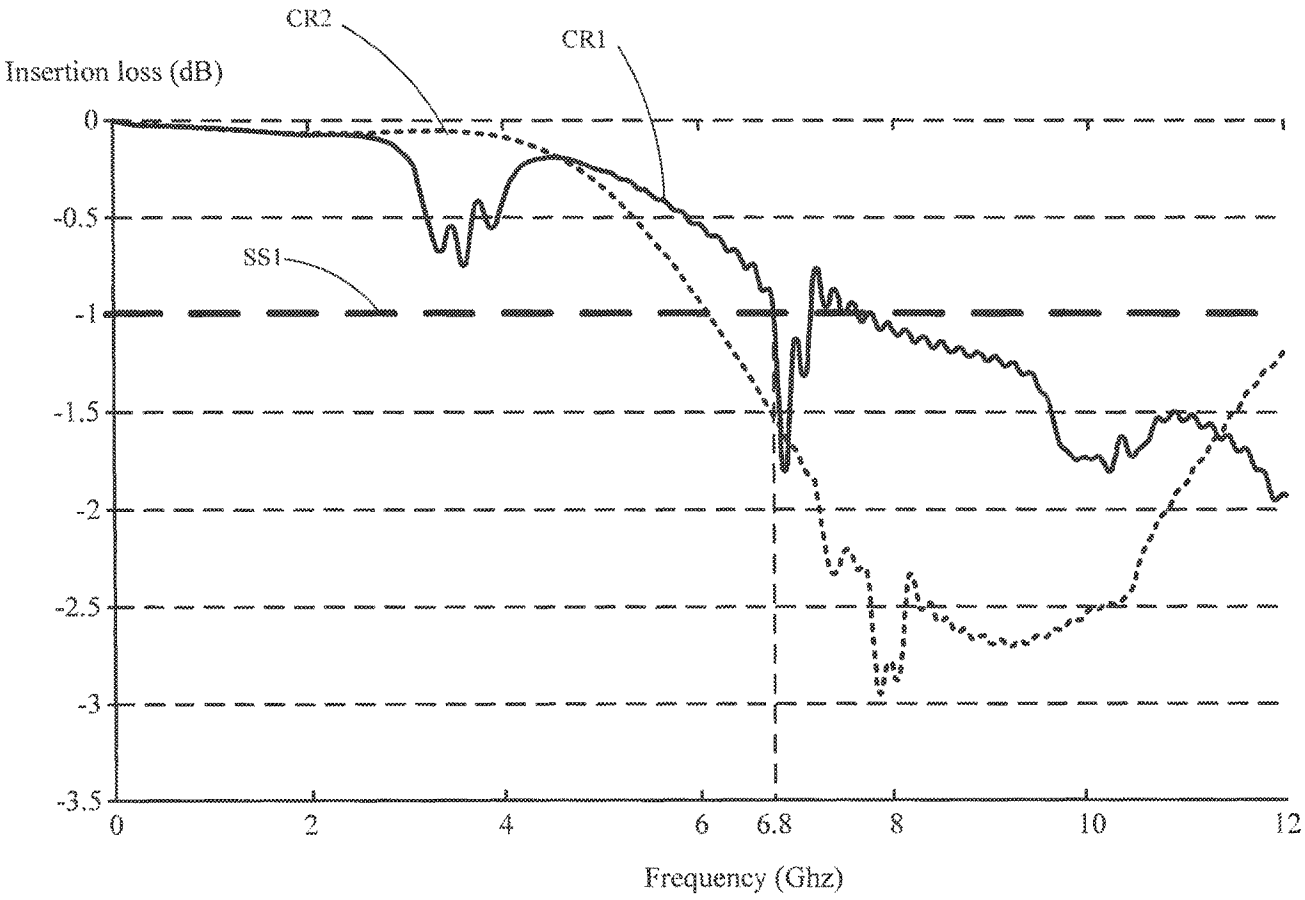
Figure 6C:
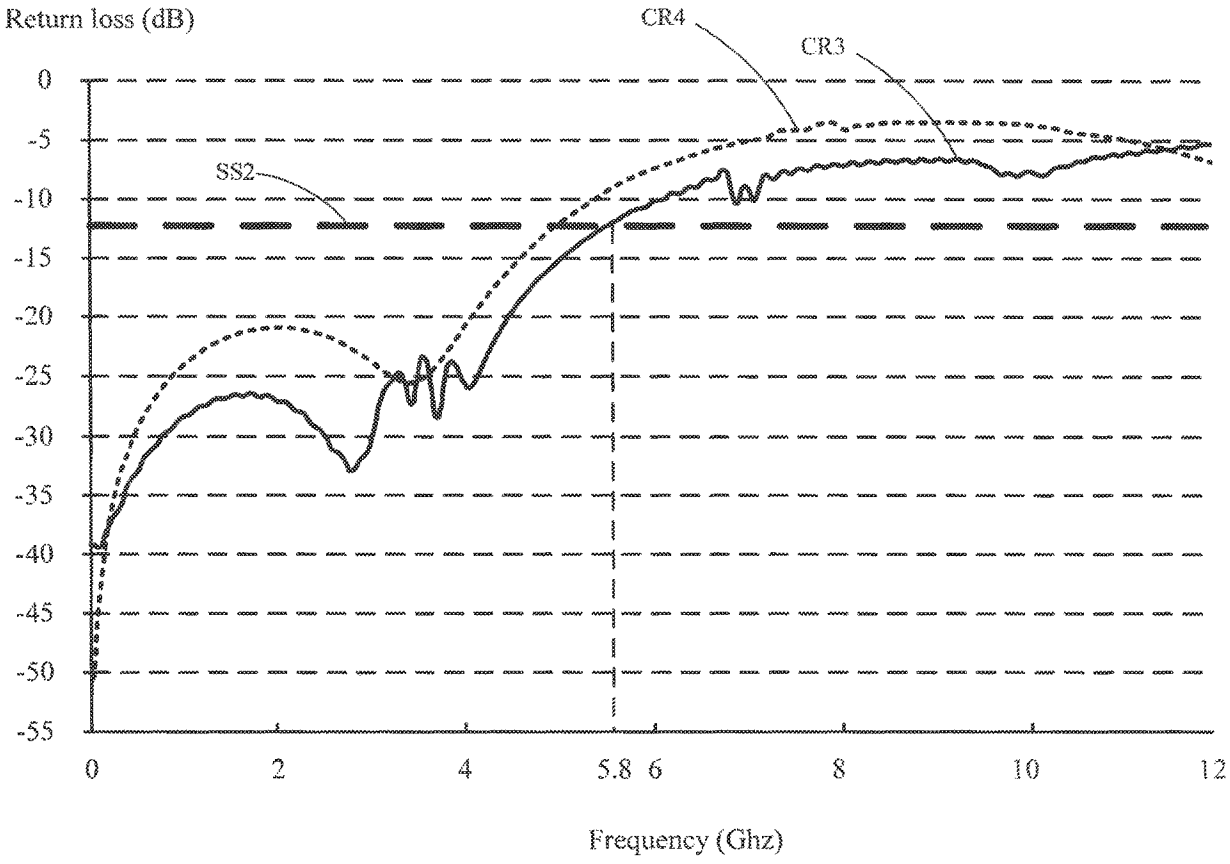

Please refer to FIGS. 6B and 6C. FIGS. 6B-6C are schematic electrical characteristics waveform views of conductive contacts according to the first embodiment of the present invention. As shown in FIG. 6B, the horizontal axis represents frequency (Giga-hertz, Ghz) and the vertical axis represents an insertion loss in an unit of decibel (dB) wherein the insertion loss −1 dB is defined as a standard insertion loss SS1. When the insertion loss of the conductive contacts is greater than the standard insertion loss SS1, the crosstalk interference is decreased and thus the signal quality is better. On the contrary, when the insertion loss of the conductive contacts is less than the standard insertion loss SS1, the crosstalk interference is increased and thus the signal quality is poor. In FIG. 6B, when the frequency of the curve CR1 of the conductive contacts of the present invention is 6.8 Ghz, the insertion loss of the conductive contacts is advantageously equal to or greater than the standard insertion loss SS1. However, when the frequency of the curve CR2 of the conventional conductive contacts is 6.8 Ghz, the insertion loss, i.e. −1.5 dB, of the conductive contacts is disadvantageously less than the standard insertion loss SS1. Therefore, the high frequency electrical connector is capable of improving the crosstalk interference of the conventional electrical connector.

As shown in FIG. 6C, the horizontal axis represents frequency (Ghz) and the vertical axis represents a return loss in an unit of decibel (dB) wherein the return loss −12 dB is defined as a standard return loss SS2. When the return loss of the conductive contacts is less than the standard return loss SS2, the crosstalk interference is decreased and thus the signal quality is better. On the contrary, when the return loss of the conductive contacts is greater than the standard return loss SS2, the crosstalk interference is increased and thus the signal quality is poor. In FIG. 6C, when the frequency of the curve CR3 of the conductive contacts of the present invention is 5.8 Ghz, the return loss of the conductive contacts is advantageously less than the standard return loss SS2. However, when the frequency of the curve CR4 of the conventional conductive contacts is 5.8 Ghz, the return loss, i.e. −10 dB, of the conductive contacts is disadvantageously greater than the standard return loss SS2. Therefore, the high frequency electrical connector is capable of improving the crosstalk interference of the conventional electrical connector based on FIGS. 6B and 6C.

Please continuously refer to FIG. 2. The high frequency electrical connector further comprises a plurality of third type conductive contacts 106 for being inserted to a plurality of third contact slots 114*c* of the insulated housing 100 correspondingly wherein each third type conductive contact 106 comprises a third soldering portion 116*c*, a third resilient portion 120*c*, a bending contact portion 117 and a third free end portion 126*c*. The length between the third soldering portion 116*c* and the third free end portion 126*c* is greater than a length between the first soldering portion 116*a* and the first free end portion 126*a* of the first type conductive contact 102. In one embodiment, the arrangement pitch DP of the third type conductive contacts 106 is greater than that of second type conductive contact 104 and the arrangement pitch DP of the second type conductive contacts 104 is greater than that of first type conductive contact 102.

Figure 7:
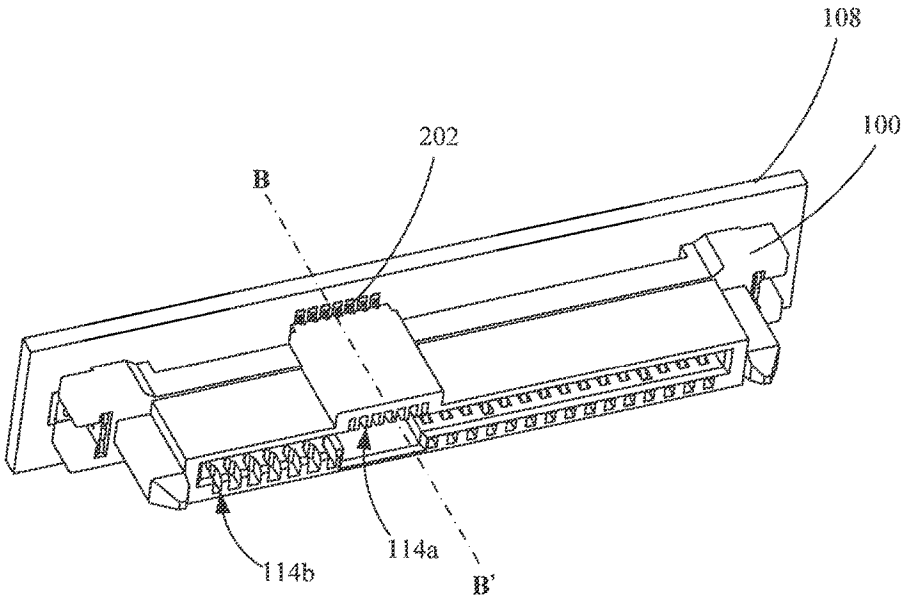
FIG. 7 is a schematic three-dimensional assembly view of a high frequency electrical connector according to a second embodiment of the present invention.
Figure 8:
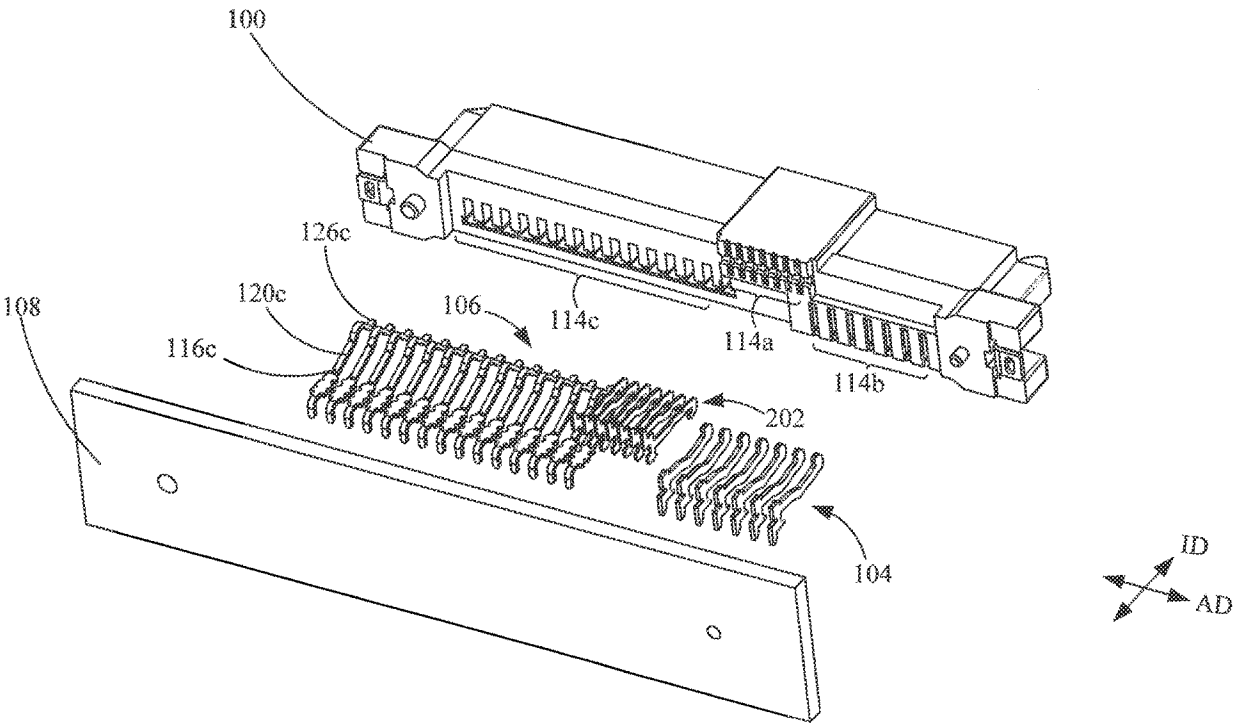
FIG. 8 is a schematic exploded view of the high frequency electrical connector in FIG. 7 according to the second embodiment of the present invention.
Figure 9:
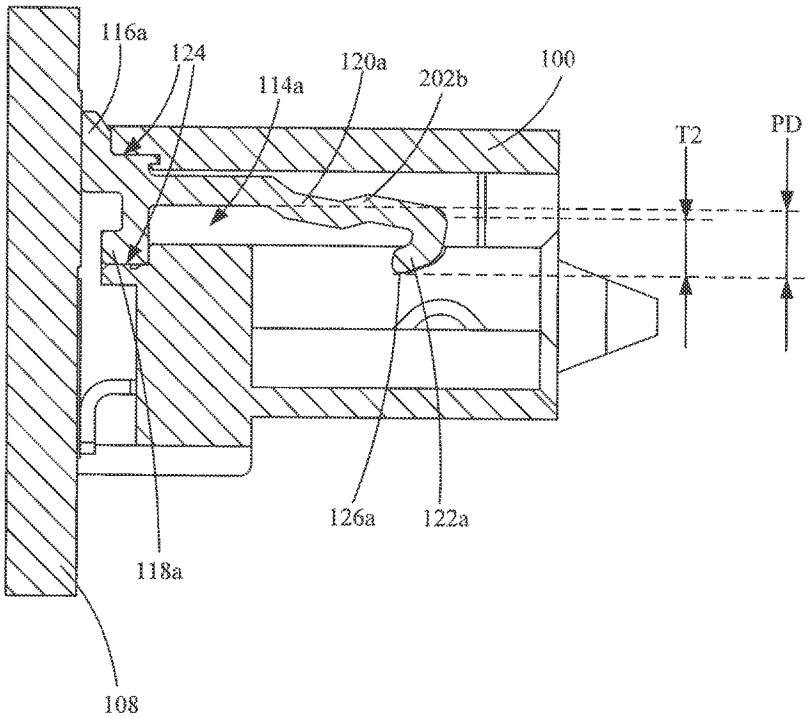
FIG. 9 is a schematic cross-sectional view of the high frequency electrical connector in FIG. 7 along the line B-B' according to the second embodiment of the present invention.
Figure 10B:
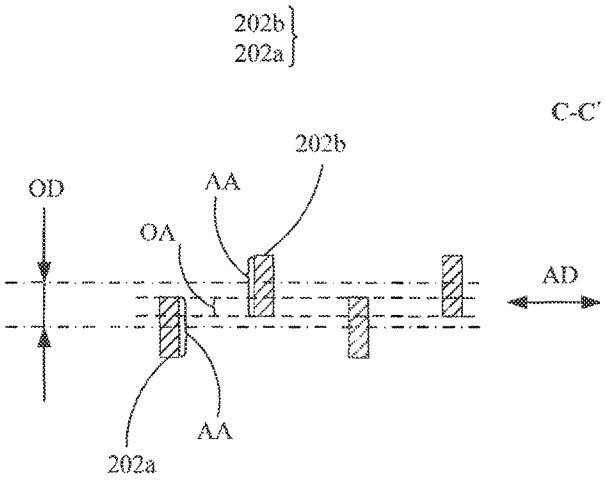
FIG. 10B is a schematic cross-sectional view of the first type conductive contacts with different types in FIG. 10A along the line C-C' according to the second embodiment of the present invention.
Figure 10A:
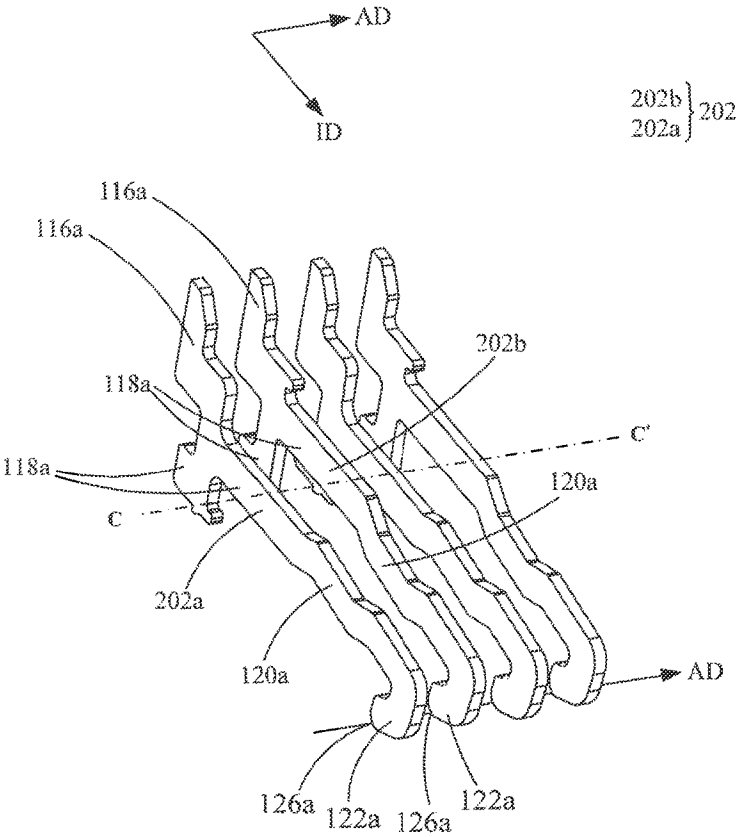
FIG. 10A is a schematic three-dimensional view of adjacent first type conductive contacts with different types according to the second embodiment of the present invention.

Please refer to FIGS. 7 through 9 and 10A through 10B. FIG. 7 is a schematic three-dimensional assembly view of a high frequency electrical connector according to a second embodiment of the present invention. FIG. 8 is a schematic exploded view of the high frequency electrical connector in FIG. 7 according to the second embodiment of the present invention. FIG. 9 is a schematic cross-sectional view of the high frequency electrical connector in FIG. 7 along the line B-B' according to the second embodiment of the present invention. FIG. 10A is a schematic three-dimensional view of adjacent first type conductive contacts 202 with different types according to the second embodiment of the present invention. FIG. 10B is a schematic cross-sectional view of the first type conductive contacts with different types in FIG. 10A along the line C-C' according to the second embodiment of the present invention. The high frequency electrical connector comprises an insulated housing 100, a plurality of first type conductive contacts 202, a plurality of second type conductive contacts 104, a plurality of third type conductive contacts 106 and a circuit board 108. The high frequency electrical connector in the second embodiment is similar to that in the first embodiment wherein the difference is that the first type conductive contacts 202 in the second embodiment is not the same as the first type conductive contacts 102 in the first embodiment.

In FIGS. 8, 9, 10A and 10B, an insulated housing 100 forms a plurality of first contact slots 114*a* and a plurality of second contact slots 114*b* which are assembled in the insulated housing 100 along an arrangement direction AD. A plurality of first type conductive contacts 202 are inserted to the first contact slots 114*a* of the insulated housing 110 correspondingly wherein each first type conductive contact 202 comprises a first soldering portion 116*a*, a first retention portion 118*a*, a first resilient portion 120 and a first contact portion 122*a*. The first soldering portions 116*a* extend outwardly from the insulated housing 100. In one embodiment, first soldering portions 116*a* are the soldering pins using surface mounting technique (SMT) to electrically connecting to the soldering pads (not shown) in the rear end of the circuit board 108. The first retention portion 118*a* is connected to the first soldering portion 116*a* for resisting on a sidewall 124 within the insulated housing 100 in order to retain the first type conductive contact 202 into the first contact slot 114*a* of the insulated housing 100 correspondingly. The first contact portion 122*a* is connected to the first resilient portion 120*a* at an angle and comprises a first free end portion 126*a* at a distal part of the first contact portion 122*a*.

As shown in FIGS. 8, 9, 10A and 10B, each first type conductive contacts 202 in the second embodiment comprise first group conductive terminals 202*a* and second group conductive terminals 202*b*. Each of the first group conductive terminals 202*a* is different from each of the second group conductive terminals 202*b*. Each transverse section of the first resilient portion 120*a* of each first group conductive terminal 220*a* and each transverse section of the first resilient portion 120*a* of each second group conductive terminal 202*b* are interlaced in the front and rear along the arrangement direction AD within the first contact slots 114*a* of the insulated housing 100. The first free end portions 126*a* of the first group conductive terminals 202*a* and the second group conductive terminals 202*b* are formed by a collinear status or a coplanar status so that the first free end portions 126*a* of the first group conductive terminals 202*a* and the second group conductive terminals 202*b* can be electrically connected to each mating contact 112 simultaneously. An overlapped region OA between two adjacent first resilient portions 120*a* of the interlaced first group conductive terminal 202*a* and second group conductive terminal 202*b* along the arrangement direction AD is less than a surface region AA of the first resilient portion 120*a* of either the interlaced first group conductive terminal 202*a* or second group conductive terminal 202*b* along the arrangement direction for adjusting the capacitance and impedance between the interlaced first group conductive terminal 202*a* and second group conductive terminal 202*b*. For example, with respect to the same surface region AA, the capacitance is decreased if the overlapped region OA is diminished. With respect to the same overlapped region OA, the impedance is decreased if the surface region AA is increased. An offset distance OD is formed between a center line of the transverse section of the first resilient portion 120*a* of each first group conductive terminal 202*a* and a center line of the transverse section of the first resilient portion 120*a* of each second group conductive terminal 202*b* along the arrangement direction AD wherein the offset distance OD is negatively related to the overlapped region OA.

Figure 10C:
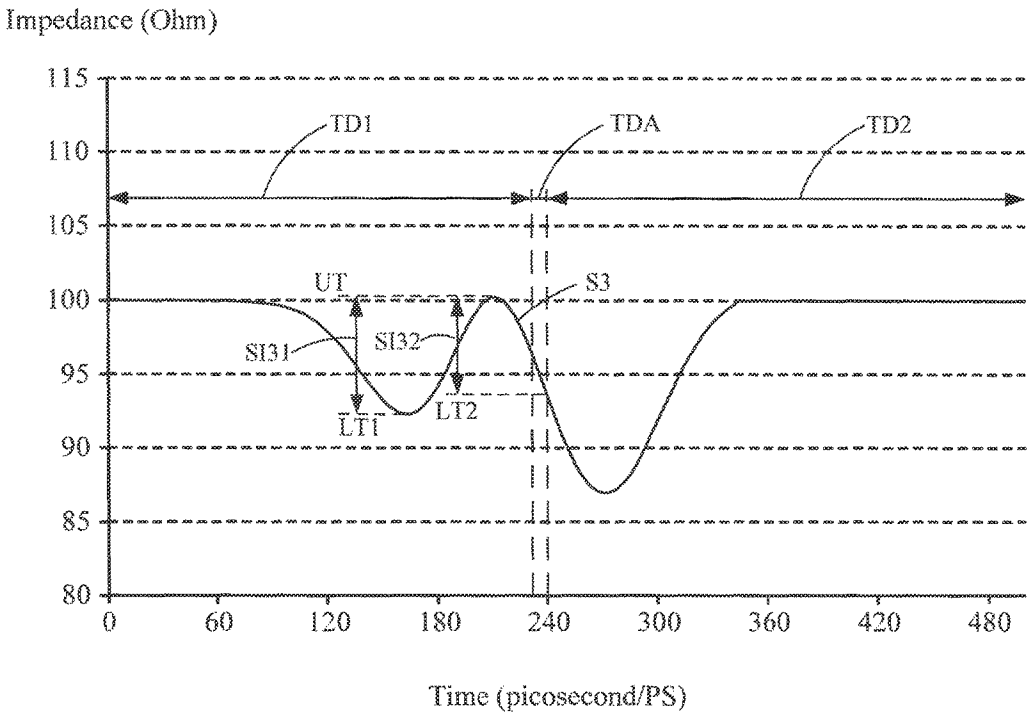
FIG. 10C is a schematic electrical characteristics waveform view of first type conductive contacts according to the second embodiment of the present invention.

FIG. 10C is a schematic electrical characteristics waveform view of first type conductive contacts 202 according to the second embodiment of the present invention. As shown in FIG. 10C, the horizontal axis represents time (picosecond, PS) and the vertical axis represents impedance value (ohms). The curve S3 is an impedance curve of the high frequency electrical connector which comprises a variety of impedance values corresponding to a plurality of continuous time intervals wherein the continuous time intervals includes a first time interval TD1 (e.g. corresponding to female electrical connector), an interactive time interval TDA (e.g. corresponding to male and female electrical connectors), a second time interval TD2 (e.g. corresponding to male electrical connector). In the first time interval TD1, the impedance interval SI31 represents a first differential impedance interval which is defined as a upper limit (UT) and a first lower limit (LT1) and the impedance interval SI32 represents a second differential impedance interval which is defined as a upper limit (UT) and a second lower limit (LT2).

In the present invention, each one of the first impedance interval SI31, the upper limit (UT), the first lower limit (LT1), the second impedance interval SI32 and the second lower limit (LT2) is configured within a reference differential impedance interval, e.g. the range from 85 to 115 ohms but not limited, e.g. from 75 to 125 ohms. Thus, the impedance matching of the first type conductive contact 202 of the high frequency electrical connector in the present invention is improved to reduce an amplitude decay of the high frequency signal. Based on the above descriptions, the present invention utilizes a high frequency electrical connector for configuring the contact arrangement between the first type conductive contacts 202 to optimize the impedance matching status between the high frequency electrical connector and the opposite electrical connector 110. As shown in FIGS. 9 and 10C, by adjusting the ratio of the surface region AA and the overlapped region OA, the first impedance interval SI31, the upper limit (UT), the first lower limit (LT1), the second impedance interval SI32 and the second lower limit (LT2) is configured within the reference differential impedance interval. In other words, the high frequency signal is transmitted from the opposite electrical connector 110 to an electrical device (not shown) via the high frequency electrical connector wherein the decay of the high frequency signal is less than a threshold value so that the signal amplitude is not unduly decreased during the transmission process to increase the transmission quality of the high frequency signal in the high frequency electrical connector.

Figure 11B:
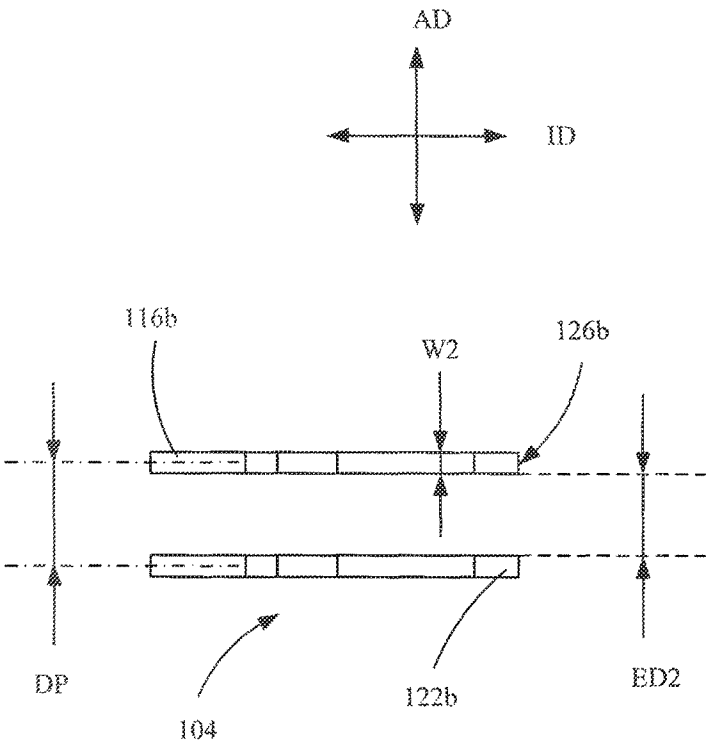
FIG. 11B is a schematic planar view of two adjacent second type conductive contacts according to the second embodiment of the present invention.
Figure 11A:
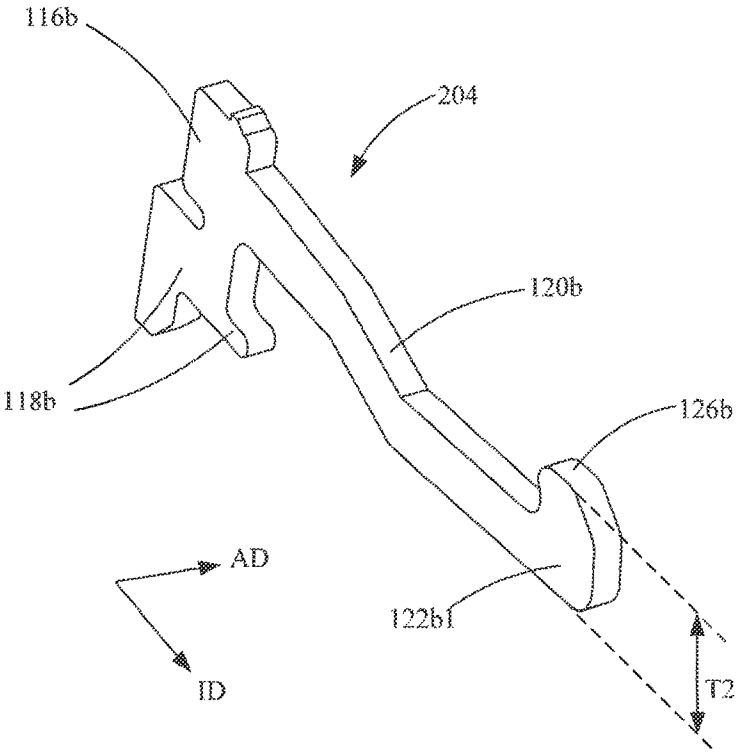
FIG. 11A is a schematic three-dimensional view of a second type conductive contact according to the first embodiment of the present invention.
Figure 11C:
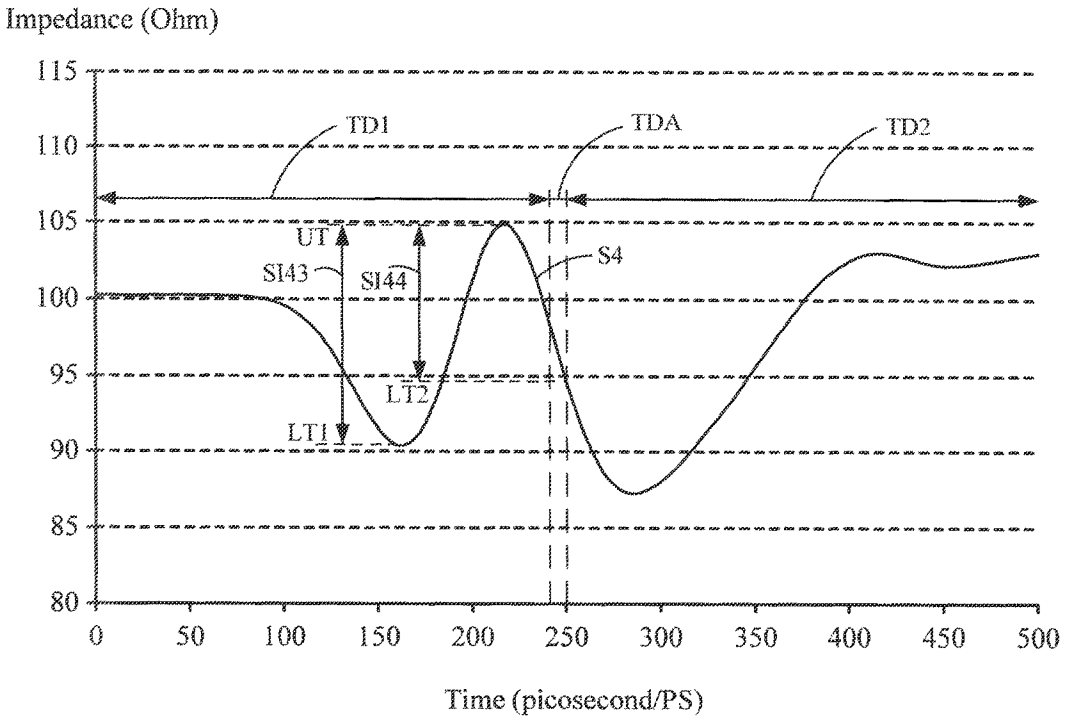
FIG. 11C is a schematic electrical characteristics waveform view of second type conductive contacts according to the second embodiment of the present invention.

Please refer to FIGS. 7 and 11A through 11C. FIG. 11A is a schematic three-dimensional view of a second type conductive contact 204 according to the first embodiment of the present invention. FIG. 11B is a schematic planar view of two adjacent second type conductive contacts 204 according to the second embodiment of the present invention. FIG. 11C is a schematic electrical characteristics waveform view of second type conductive contacts 204 according to the second embodiment of the present invention. A plurality of second type conductive contacts 204 are inserted to the second contact slots 114*b* of the insulated housing 100 correspondingly. The second type conductive contacts 204 in the second embodiment is similar to these in the first embodiment wherein the difference is that the second contact portion 122*b*1 of the second type conductive contacts 204 in the second embodiment is not the same as the second contact portion 122*b* of the second type conductive contacts 104 in the first embodiment. Specifically, the arc angle of the second contact portion 122*b*1 of the second type conductive contacts 204 is greater than that of the second contact portion 122*b* of the second type conductive contacts 104 so that the region of the second contact portion 122*b*1 of the second type conductive contacts 204 along the arrangement direction AD is less than the region of the second contact portion 122*b* of the second type conductive contacts 104.

FIG. 11C is a schematic electrical characteristics waveform view of second type conductive contacts 204 according to the second embodiment of the present invention. As shown in FIG. 11C, the horizontal axis represents time (picosecond, PS) and the vertical axis represents impedance value (ohms). The curve S4 is an impedance curve of the high frequency electrical connector which comprises a variety of impedance values corresponding to a plurality of continuous time intervals wherein the continuous time intervals includes a first time interval TD (e.g. corresponding to female electrical connector), an interactive time interval TDA (e.g. corresponding to male and female electrical connectors), a second time interval TD2 (e.g. corresponding to male electrical connector). In the first time interval TD1, the impedance interval SI43 represents a third differential impedance interval which is defined as a upper limit (UT) and a first lower limit (LT1) and the impedance interval SI44 represents a fourth differential impedance interval which is defined as a upper limit (UT) and a second lower limit (LT2). In the present invention, each one of the third impedance interval S143, the upper limit (UT), the first lower limit (LT1), the fourth impedance interval SI44 and the second lower limit (LT2) is configured within a reference differential impedance interval, e.g. the range from 85 to 115 ohms but not limited, e.g. from 75 to 125 ohms. Thus, the impedance matching of the second type conductive contact 204 of the high frequency electrical connector in the present invention is improved. In one embodiment, a differential impedance of the second type conductive contacts 204 is either less than or equal to a reference differential impedance defined in SAS-3 protocol or a later version for reducing the amplitude decay of the high frequency signal. Based on the above descriptions, the present invention utilizes a high frequency electrical connector for configuring the contact arrangement between the second type conductive contacts 204 to optimize the impedance matching status between the high frequency electrical connector and the opposite electrical connector 110. For example, the electrical connection positions of the second contact portions 122*b*1 and/or the second free end portions 126*b* can be adjusted. In other words, the high frequency signal is transmitted from the opposite electrical connector 110 to an electrical device (not shown) via the high frequency electrical connector wherein the decay of the high frequency signal is less than a threshold value so that the signal amplitude is not unduly decreased during the transmission process to increase the transmission quality of the high frequency signal in the high frequency electrical connector.

According to the aforementioned descriptions, the present invention provides a high frequency electrical connector for adjusting a differential impedance interval to be within the reference differential impedance interval in order to improve the impedance matching reliability of the high frequency electrical connector and avoid crosstalk between the conductive contacts.

As is understood by a person skilled in the art, the foregoing preferred embodiments of the present invention are illustrative rather than limiting of the present invention. It is intended that they cover various modifications and similar arrangements be included within the spirit and scope of the present invention, the scope of which should be accorded the broadest interpretation so as to encompass all such modifications and similar structures.

What is claimed is:

1. A high frequency electrical connector, comprising:

an insulated housing comprising a plurality of first contact slots and a plurality of second contact slots which are assembled in the insulated housing along an arrangement direction;

a plurality of first type conductive contacts, for being inserted to the first contact slots of the insulated housing correspondingly, wherein each first type conductive contact comprises:

a first soldering portion, for extending outwardly from the insulated housing;

a first retention portion connected to the first soldering portion, for resisting on a sidewall within the insulated housing in order to retain the first type conductive contact into the first contact slot of the insulated housing correspondingly;

a first resilient portion, for extending a predetermined distance from the first retention portion to an insertion direction of the high frequency electrical connector; and a first contact portion connected to the first resilient portion at an angle and having a first free end portion at a distal part of the first contact portion, wherein the first free end portion forms a first width along the arrangement direction, the first contact portion forms a first thickness along a direction which is perpendicular to the arrangement direction and the insertion direction, and the first thickness is greater than the first width; and a plurality of second type conductive contacts, for being inserted to the second contact slots of the insulated housing correspondingly;

wherein the first free end portions of the first type conductive contacts electrically connects the corresponding contacts of a mating electrical connector at the angle for transmitting a high frequency signal to the mating electrical connector so as to reduce an amplitude decay when the high frequency electrical connector sends the high frequency signal.

2. The high frequency electrical connector of claim 1, wherein the high frequency electrical connector is a non-metal shielding electrical connector which is compatible to a protocol selected from one group consisting of SATA protocol, SAS-3 protocol and the combination.

3. The high frequency electrical connector of claim 1, wherein a differential impedance of the first type conductive contacts is either less than or equal to a reference differential impedance defined in SAS-3 protocol or a later version for reducing the amplitude decay of the high frequency signal.

4. The high frequency electrical connector of claim 3, wherein the reference differential impedance has a range from 85 to 115 ohms.

5. The high frequency electrical connector of claim 1, wherein two lateral sides of two adjacent first type conductive contacts are spaced a first edge distance apart and two lateral sides of two adjacent second type conductive contacts are spaced a second edge distance apart which is greater than the first edge distance.

6. The high frequency electrical connector of claim 1, wherein each second type conductive contact comprises:

a second soldering portion, for extending outwardly from the insulated housing;

a second retention portion connected to the second soldering portion, for resisting on a sidewall of the second contact slot in order to retain the second type conductive contact into the second contact slot of the insulated housing correspondingly;

a second resilient portion, for extending a predetermined distance from the second retention portion to the insertion direction of the high frequency electrical connector; and a second contact portion connected to the second resilient portion at an angle and having a second free end portion at a distal part of the second contact portion, wherein the second end portion forms a second width along the arrangement direction, the second contact portion forms a second thickness along a direction which is perpendicular to the arrangement direction and the insertion direction, and the second thickness is greater than the second width.

7. The high frequency electrical connector of claim 1, wherein the first type conductive contacts and the second type conductive contacts are formed by a blanking type.

8. The high frequency electrical connector of claim 1, wherein when the second free end portions of the second type conductive contacts electrically connects the corresponding contacts of the mating electrical connector for transmitting the high frequency signal to the mating electrical connector, a reference differential impedance of the second type conductive contacts is either less than or equal to a differential impedance defined in SATA protocol for reducing the amplitude decay of the high frequency signal.

9. The high frequency electrical connector of claim 8, wherein the reference differential impedance has a range from 85 to 115 ohms.

10. The high frequency electrical connector of claim 1, wherein the first type conductive contacts comprise:

a first group conductive terminals; and a second group conductive terminals, wherein a transverse section of the first resilient portion of each first group conductive terminal and a transverse section of the first resilient portion of each second group conductive terminal are interlaced in the front and rear along the arrangement direction within the first contact slots of the insulated housing, and the first free end portions of the first group conductive terminals and the second group conductive terminals are formed by a collinear status or a coplanar status.

11. The high frequency electrical connector of claim 10, wherein an overlapped region between two adjacent first resilient portions of the interlaced first group conductive terminal and second group conductive terminal along the arrangement direction is less than a surface region of the first resilient portion of either the interlaced first group conductive terminal or second group conductive terminal along the arrangement direction.

12. The high frequency electrical connector of claim 10, wherein an offset distance is formed between a center line of the transverse section of the first resilient portion of each first group conductive terminal and a center line of the transverse section of the first resilient portion of each second group conductive terminal along the arrangement direction.

13. The high frequency electrical connector of claim 1, further comprising a plurality of third type conductive contacts, for being inserted to a plurality of third contact slots of the insulated housing correspondingly wherein each third type conductive contact comprises a third soldering portion, a third resilient portion, a bending contact portion and a third free end portion, and a length between the third soldering portion and the third free end portion is greater than a length between the first soldering portion and the first free end portion of the first type conductive contact.

14. A high frequency electrical connector, comprising:

an insulated housing comprising a plurality of first contact slots and a plurality of second contact slots which are assembled in the insulated housing along an arrangement direction;

a plurality of first type conductive contacts, for being inserted to the first contact slots of the insulated housing correspondingly wherein each first type conductive contact comprises a first resilient portion and a first contact portion which is connected to the first resilient portion at an angle and comprises a first free end portion at a distal part of the first contact portion, and the first type conductive contacts comprise:

a first group conductive terminals; and a second group conductive terminals which are different from the first group conductive terminals, wherein a transverse section of the first resilient portion of each first group conductive terminal and a transverse section of the second resilient portion of each second group conductive terminal are interlaced in the front and rear along the arrangement direction within the first contact slots of the insulated housing, and the first free end portions of the first group conductive terminals and the second group conductive terminals are formed by a collinear status or a coplanar status; and a plurality of second type conductive contacts, for being inserted to the second contact slots of the insulated housing correspondingly.

15. The high frequency electrical connector of claim 14, wherein the high frequency electrical connector is a non-metal shielding electrical connector which is compatible to a protocol selected from one group consisting of SATA protocol, SAS-3 protocol and the combination.

16. The high frequency electrical connector of claim 14, wherein two lateral sides of two adjacent first type conductive contacts forms a first edge distance and two lateral sides of two adjacent second type conductive contacts forms a second edge distance which is greater than the first edge distance.

17. The high frequency electrical connector of claim 14, wherein the first type conductive contacts and the second type conductive contacts are formed by a blanking type.

18. The high frequency electrical connector of claim 17, wherein each second type conductive contact comprises:

a second resilient portion; and a second contact portion connected to the second resilient portion at an angle and having a second free end portion at a distal part of the second contact portion.

19. The high frequency electrical connector of claim 17, wherein when the second free end portions of the second type conductive contacts electrically connects the corresponding contacts of a mating electrical connector for transmitting the high frequency signal to the mating electrical connector, a reference differential impedance of the second type conductive contacts is either less than or equal to a differential impedance defined in SATA protocol for reducing the amplitude decay of the high frequency signal.

20. The high frequency electrical connector of claim 19, wherein the reference differential impedance has a range from 85 to 115 ohms.

21. The high frequency electrical connector of claim 14, wherein an overlapped region between two adjacent first resilient portions of the interlaced first group conductive terminal and second group conductive terminal along the arrangement direction is less than a surface region of the first resilient portion of either the interlaced first group conductive terminal or second group conductive terminal along the arrangement direction.

22. The high frequency electrical connector of claim 14, wherein an offset distance is formed between a center line of the transverse section of the first resilient portion of each first group conductive terminal and a center line of the transverse section of the second resilient portion of each second group conductive terminal along the arrangement direction.

23. The high frequency electrical connector of claim 14, further comprising a plurality of third type conductive contacts, for being inserted to a plurality of third contact slots of the insulated housing correspondingly wherein each third type conductive contact comprises a third soldering portion, a third resilient portion, a bending contact portion and a third free end portion, and a length between the third soldering portion and the third free end portion is greater than a length between the first soldering portion and the first free end portion of the first type conductive contact.

* * * * *